US008257053B2

(12) United States Patent
Hase et al.

(10) Patent No.: US 8,257,053 B2
(45) Date of Patent: Sep. 4, 2012

(54) COMPRESSED AIR MANUFACTURING FACILITY

(75) Inventors: Masakazu Hase, Shizuoka (JP); Hiroyuki Matsuda, Yaidu (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 375 days.

(21) Appl. No.: 11/688,414

(22) Filed: Mar. 20, 2007

(65) Prior Publication Data

US 2008/0014097 A1 Jan. 17, 2008

(30) Foreign Application Priority Data

Jul. 11, 2006 (JP) ..... 2006-190728

(51) Int. Cl.
*F04B 49/06* (2006.01)

(52) U.S. Cl. ..... 417/44.2; 417/18; 417/20

(58) Field of Classification Search ..... 417/42, 417/216, 44.1, 44.2, 18, 20
See application file for complete search history.

(56) References Cited

U.S. PATENT DOCUMENTS

| | | | | |
|---|---|---|---|---|
| 6,287,083 | B1 * | 9/2001 | Hase et al. | 417/216 |
| 6,599,094 | B2 * | 7/2003 | Kanazaki et al. | 417/53 |
| 2003/0039550 | A1 | 2/2003 | Wichert | |

FOREIGN PATENT DOCUMENTS

| | | | |
|---|---|---|---|
| JP | 56-086390 | | 7/1981 |
| JP | 06-173878 | | 6/1994 |
| JP | 06173878 | A * | 6/1994 |
| JP | 11-324963 | | 11/1999 |
| JP | 2004-190583 | | 7/2004 |
| JP | 2006-152946 | | 6/2006 |

* cited by examiner

*Primary Examiner* — Charles Freay
*Assistant Examiner* — Todd D Jacobs
(74) *Attorney, Agent, or Firm* — Antonelli, Terry, Stout & Kraus, LLP.

(57) ABSTRACT

In order to provide a compressed air manufacturing facility which can increase a stability of a supply pressure while obtaining an energy saving effect, in a compressed air manufacturing facility provided with a compressor compressing an air, an electric motor driving the compressor, and an inverter variably controlling a rotating speed of the electric motor, the compressed air manufacturing facility is provided with a pressure sensor detecting a discharge pressure of the compressor at an upstream side position of a discharge air system connected to a discharge side of the compressor, and a control apparatus computing a pressure loss of the discharge air system in correspondence to a rotating speed of the electric motor, and changing a control range of the discharge pressure of the compressor at the upstream side position of the discharge air system on the basis of the computation in such a manner that a terminal pressure at a downstream side position of the discharge air system comes to a predetermined range, and variably controlling the rotating speed of the electric motor via the inverter in such a manner that the discharge pressure of the compressor detected by the pressure sensor comes to the changed control range.

9 Claims, 4 Drawing Sheets

COMPRESSED AIR MANUFACTURING FACILITY

The present application claims priority from Japanese application JP2006-190728 filed on Jul. 11, 2006, the content of which is hereby incorporated by reference into this application.

BACKGROUND OF THE INVENTION (1) Field of the Invention

The present invention relates to a compressed air manufacturing facility provided with a compressor driven by an electric motor in which a rotating speed is variably controlled by an inverter.

(2) Description of Related Art

The compressed air manufacturing facility is provided with a compressor compressing an air, for example, serving as a variable speed compressor unit executing a capacity control, an electric motor driving the compressor, an inverter variably controlling a rotating speed of the electric motor, a pressure sensor detecting a discharge pressure of the compressor, and a control apparatus variably controlling the rotating speed of the electric motor via the inverter on the basis of a deviation between the discharge pressure detected by the pressure sensor and a control pressure. Further, as a structure provided with a plurality of variable speed compressor units, there have been know a structure in which the units are operated in parallel, and a structure in which the units are operated alternately and in a following manner. Further, for example, in a structure provided with a plurality of compressor units including at least one variable speed compressor unit, there has been known a structure in which one variable speed compressor unit is operated by variably controlling a rotating speed of a corresponding electric motor via an inverter, and the other compressor units are switched to a full-load operation state at a rotating speed which has an upper limit of the rotating speed of the corresponding electric motor or a stop state, thereby controlling a number of the units.

In this case, a pressure loss of a discharge air system supplying the compressed air discharged from the compressor to a supply end is changed in correspondence to a change of an amount of a discharge air of the compressor and an amount of a used air of the supply end. Accordingly, in general, a control range of the discharge pressure of the compressor at an upstream side position of the discharge air system is set by anticipating a maximum pressure loss of the discharge air system in such a manner that a terminal pressure (a supply pressure) at a downstream side position of the discharge air system comes to a desired pressure value or more. In the compressed air manufacturing facility mentioned above, it is possible to obtain a desired compressed air, however, for example, in the case that the amount of the used air is small (that is, the amount of the discharge air of the compressor becomes smaller), the control range of the discharge pressure of the compressor is kept high in spite that the pressure loss of the discharge air system becomes smaller. Accordingly, the compressor is driven more than necessary, and an extra power is consumed.

Accordingly, in order to correspond to this problem, for example, there has been proposed a control apparatus variably controlling a rotating speed of the electric motor in such a manner that the terminal pressure at the downstream side position of the discharge air system comes to a predetermined range in correspondence to the discharge pressure of the compressor at the upstream side position of the discharge air system detected by the pressure sensor (for example, refer to JP-A-2004-190583). Describing in detail, the control apparatus previously stores a pressure loss (=discharge pressure of the compressor at the upstream side position−terminal pressure at the downstream side position) of the discharge air system at a time of a specification pressure, and is structured such as to compute a pressure loss of the discharge air system on the basis of a ratio between the discharge pressure of the compressor detected by the pressure sensor and the specification pressure. Further, the structure is made such as to compute the control range of the discharge pressure of the compressor obtained by adding a computed value of the pressure loss of the discharge air system to a predetermined range of the terminal pressure at the downstream side position of the discharge air system, and variably control the rotating speed of the electric motor on the basis of the computation.

BRIEF SUMMARY OF THE INVENTION

However, there is the following room for improvement in the prior art mentioned above.

In other words, the control apparatus mentioned above is provided with a first function of computing the pressure loss of the discharge air system in correspondence to the discharge pressure of the compressor detected by the pressure sensor and changing the control range of the discharge pressure of the compressor on the basis of this computation in such a manner that the terminal pressure at the downstream side position of the discharge air system comes to the predetermined range, and a second function of variably controlling the rotating speed of the electric motor via the inverter in such a manner that the discharge pressure of the compressor detected by the pressure sensor comes to the control range changed by the first function. However, the first function is based on an assumption that a relation between the control amount (the discharge pressure of the compressor) in accordance with the second function and the operation amount (the rotating speed of the electric motor) is sufficiently kept, and the structure is made such that a convergence characteristic of the discharge pressure of the compressor in accordance with the first function and a convergence characteristic of the rotating speed of the electric motor in accordance with the second function are affected by each other. Accordingly, for example, in the case that the amount of the used air is largely changed, the discharge pressure of the compressor and the rotating speed of the electric motor generate a hunting, and the terminal pressure at the downstream side position of the discharge air system, that is, the supply pressure becomes unstable.

The present invention is made by taking the problem of the prior art mentioned above into consideration, and an object of the present invention is to provide a compressed air manufacturing facility which can increase a stability of a supply pressure while obtaining an energy saving effect.

(1) In order to achieve the object mentioned above, in accordance with the present invention, there is provided a compressed air manufacturing facility comprising:
- a compressor compressing an air;
- an electric motor driving the compressor; and
- an inverter variably controlling a rotating speed of the electric motor,
- wherein the compressed air manufacturing facility comprises:
- a discharge pressure changing means computing a pressure loss of a discharge air system connected to a discharge side of the compressor in correspondence to the rotating speed of the electric motor, and changing a control range of a discharge pressure of the compressor at an upstream side position of the discharge air system on the basis of the computation in such a manner that a terminal pressure at a downstream side position of the discharge air system comes to a predetermined range;

a pressure detecting means detecting the discharge pressure of the compressor at the upstream side position of the discharge air system; and a rotating speed control means variably controlling the rotating speed of the electric motor via the inverter in such a manner that the discharge pressure of the compressor detected by the pressure detecting means comes to the control range changed by the discharge pressure changing means.

In the present invention, the discharge pressure changing means computes the pressure loss of the discharge air system in correspondence to the rotating speed of the electric motor, and changes the control range of the discharge pressure of the compressor at the upstream side position of the discharge air system on the basis of the computation in such a manner that the terminal pressure at the downstream side position of the discharge air system comes to the predetermined range. Further, the rotating speed control means variably controls the rotating speed of the electric motor via the inverter in such a manner that the discharge pressure of the compressor detected by the pressure detecting means comes to the control range changed by the discharge pressure changing means. Accordingly, it is possible to hold the power of the compressor to a minimum, and it is possible to obtain an energy saving effect. Further, in the present invention, since there are provided with the discharge pressure changing means changing the control range of the discharge pressure of the compressor in correspondence to the rotating speed of the electric motor, and the rotating speed control means variably controlling the rotating speed of the electric motor in correspondence to the discharge pressure of the compressor, and the discharge pressure changing means and the rotating speed control means operate as the feedback control functions with each other, it is possible to increase a convergence characteristic of the discharge pressure of the compressor and the rotating speed of the electric motor. As a result, it is possible to stabilize the terminal pressure of the discharge air system, that is, the supply pressure. Accordingly, in the present invention, it is possible to increase a stability of the supply pressure while obtaining the energy saving effect.

(2) In order to achieve the object mentioned above, in accordance with the present invention, there is further provided a compressed air manufacturing facility comprising:

a plurality of compressors compressing an air;

a plurality of electric motors respectively driving a plurality of compressors; and a number control means operating a first compressor corresponding to one of a plurality of compressors by variously controlling a rotating speed of the electric motor corresponding thereto via an inverter, and switching the other second compressor to a full-load operation state of operating by setting the rotating speed of the electric motor corresponding thereto to an upper limit value or a stop state, wherein the compressed air manufacturing facility comprises:

a discharge pressure changing means computing a pressure loss of a discharge air system connected to a discharge side of the first and second compressors in correspondence to the rotating speed of the electric motor corresponding to the first compressor and the rotating speed of the electric motor corresponding to the second compressor, and changing a control range of a discharge pressure of the first compressor at an upstream side position of the discharge air system on the basis of the computation in such a manner that a terminal pressure at a downstream side position of the discharge air system comes to a predetermined range;

a pressure detecting means detecting the discharge pressure of the first compressor at the upstream side position of the discharge air system; and a rotating speed control means variably controlling the rotating speed of the electric motor corresponding to the first compressor via the inverter in such a manner that the discharge pressure of the first compressor detected by the pressure detecting means comes to the control range changed by the discharge pressure changing means.

(3) In the item (1) or (2) mentioned above, it is preferable that the discharge air system has an auxiliary machinery in which a pressure loss characteristic is varied with age, and the discharge pressure changing means corrects the pressure loss of the discharge air system in correspondence to the variation with age of the pressure loss characteristic of the auxiliary machinery.

(4) In the item (2) mentioned above, it is preferable that the discharge air system has a plurality of supply systems capable of supplying the compressed air discharged from each of the compressors to each of supply ends, a communication piping communicated with a plurality of supply systems, and an opening and closing valve capable of shutting off the communication piping.

In accordance with the present invention, it is possible to increase a stability of the supply pressure while obtaining the energy saving effect.

Other objects, features and advantages of the invention will become apparent from the following description of the embodiments of the invention taken in conjunction with the accompanying drawings.

DESCRIPTION OF REFERENCE NUMERALS

Figure 1:
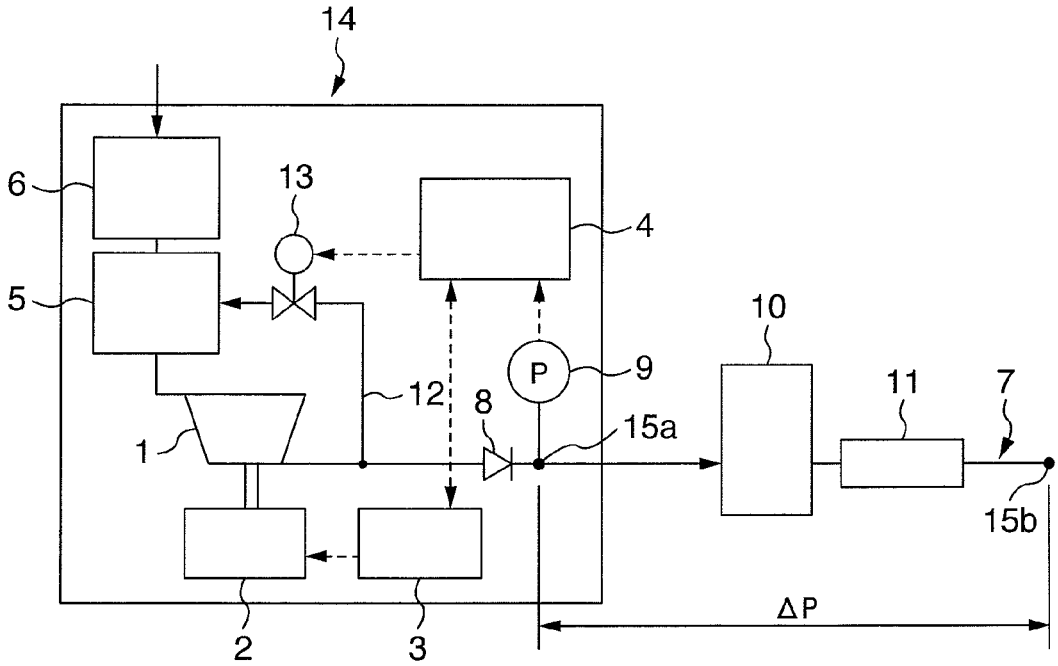
FIG. 1 is a schematic view showing an entire structure of a first embodiment of a compressed air manufacturing facility in accordance with the present invention.

1 compressor
2 electric motor
3 inverter
4 control apparatus (discharge pressure changing means, rotating speed control means)
7 discharge air system
9 pressure sensor (pressure detecting means)

11 air filter (auxiliary machinery)
15*a* upstream side position
15*b* downstream side position
18 discharge air system
19*a* upstream side position
19*b* downstream side position
19*c* upstream side position
20 external control apparatus (discharge pressure changing means)

DETAILED DESCRIPTION OF THE INVENTION

A description will be given below of embodiments in accordance with the present invention with reference to the accompanying drawings.

A first embodiment in accordance with the present invention will be described with reference to FIGS. 1 and 2.

FIG. 1 is a schematic view showing an entire structure of a compressed air manufacturing facility in accordance with the present embodiment. In this case, a solid arrow indicates an air flow, and a dotted arrow indicates a flow of an electric signal.

In this FIG. 1, the compressed air manufacturing facility is provided, for example, with an oil free type screw compressor 1, an electric motor 2 driving the compressor 1, an inverter 3 variably controlling a rotating speed of the electric motor 2, a control apparatus 4 controlling the inverter 3, a suction throttle valve 5 provided in a suction side of the compressor 1, a suction filter 6 provided in an upstream side of the suction throttle valve 5, and removing a powder dust or the like in the atmospheric air, and a discharge air system 7 connected to a discharge side of the compressor 1, and supplying a compressed air discharged from the compressor 1 to a supply end.

The discharge air system 7 is provided with a check valve 8, a pressure sensor 9 (a pressure detecting means) arranged in a downstream side of the check valve 8 and detecting a discharge pressure of the compressor 1, an air tank 10 arranged in a downstream side of the pressure sensor 9 and having a sufficient capacity, and an air filter 11 arranged in a downstream side of the air tank 10 and removing a powder dust or the like in the compressed air.

Further, in an upstream side of the check valve 8 of the discharge air system 7, there is connected a piping 12 for introducing a part of the compressed air discharged from the compressor 1 as an air for operating the suction throttle valve 5, and the piping 12 is provided with a control valve 13 which can be switched to a communication state and a shut-off state in correspondence to a control signal from the control apparatus 4. Further, for example, in the case that the control valve 13 is switched to the communication state from the shut-off state, the suction throttle valve 5 is driven so as to shut off an intake air of the compressor 1, thereby switching the compressor 1 from a load operation to an unload operation.

In this case, the compressor 1, the electric motor 2, the inverter 3, the control apparatus 4, the suction throttle valve 5, the suction filter 5, a part of the discharge air system 7 including the check valve 8 and the pressure sensor 9, the piping 12, the control valve 13 and the like are stored within a casing, and are structured as a compressor unit 14.

The control apparatus 4 corresponding to a main portion of the present embodiment is structured such as to compute a pressure loss ΔP of the discharge air system 7 (in detail, a pressure loss from a detection position 15*a* (an upstream side position) of the pressure sensor 9 in the discharge air system 7 to a downstream side position 15*b*) in correspondence to a rotating speed N of the electric motor 2, and change a control range of a discharge pressure of the compressor 1 at the upstream side position 15*a* of the discharge air system 7 on the basis of this computation in such a manner that a terminal pressure at the downstream side position 15*b* of the discharge air system 7 comes to a predetermined range, first as a first function (a discharge pressure changing means). A description will be given below of details thereof.

The pressure loss ΔP of the discharge air system 7 is in proportion to a square of the discharge air amount of the compressor 1. The control apparatus 4 previously sets and stores a maximum pressure loss ΔPmax of the discharge air system 7, for example, at a time of a maximum discharge air amount of the compressor 1 (in other words, a maximum rotating speed Nmax of the electric motor 2), and is structured such as to calculate the pressure loss ΔP of the discharge air system 7 by multiplying the maximum pressure loss ΔPmax of the discharge air system 7 by a square of a ratio of the rotating speed N/Nmax of the electric motor 2 (for example, corresponding to a rotating speed command from the control apparatus 4 to the electric motor 2) corresponding to a ratio of the discharge air amount of the compressor 1, as shown in Expression (1).

$$\Delta P = \Delta P\mathrm{max} \times (N/N\mathrm{max})2 \tag{1}$$

Further, a control value P1 of the discharge pressure of the compressor 1 is changed to a value obtained by adding the pressure loss ΔP to a predetermined value P2 of the terminal pressure (a value obtained by subtracting the maximum pressure loss ΔPmax from a predetermined control set value P1_0 of the discharge pressure of the compressor 1 which is previously set in anticipation of the maximum pressure loss ΔPmax of the discharge air system 7, in the present embodiment) (refer to Expression (2)). Further, an upper limit value P1*u* of the discharge pressure of the compressor 1 is changed to a value obtained by adding the pressure loss ΔP to a predetermined upper limit value P2*u* of the terminal pressure (a value obtained by subtracting the maximum pressure loss ΔPmax from a predetermined upper limit set value P1*u*_0 of the discharge pressure of the compressor 1 which is previously set in anticipation of the maximum pressure loss ΔPmax of the discharge air system 7, in the present embodiment) (refer to Expression (3)). Further, a lower limit value P1*d* of the discharge pressure of the compressor 1 is changed to a value obtained by adding the pressure loss ΔP mentioned above to a predetermined lower limit value P2*d* of the terminal pressure (a value obtained by subtracting the maximum pressure loss ΔPmax from a predetermined lower limit set value P1*d*_0 of the discharge pressure of the compressor 1 which is previously set in anticipation of the maximum pressure loss ΔPmax of the discharge air system 7, in the present embodiment) (refer to Expression (4)). In this case, the predetermined control set value P1_0, the predetermined upper limit set value P1*u*_0 and the predetermined lower limit set value P1*d*_0 of the discharge pressure of the compressor 1 are previously set and stored in the control apparatus 4.

$$\begin{aligned} P1 &= P2 + \Delta P \\ &= \mathrm{P1_0} - \Delta P\mathrm{max} + \Delta P \end{aligned} \tag{2}$$

$$\begin{aligned} P1u &= P2u + \Delta P \\ &= \mathrm{P1u_0} - \Delta P\mathrm{max} + \Delta P \\ &= \mathrm{Plu_0} + (P1 - \mathrm{P1_0}) \end{aligned} \tag{3}$$

-continued $$P1d = P2d + \Delta P \quad (4)$$
$$= P1d_0 - \Delta P\max + \Delta P$$
$$= Pld_0 + (P1 - P1_0)$$

Figure 2:
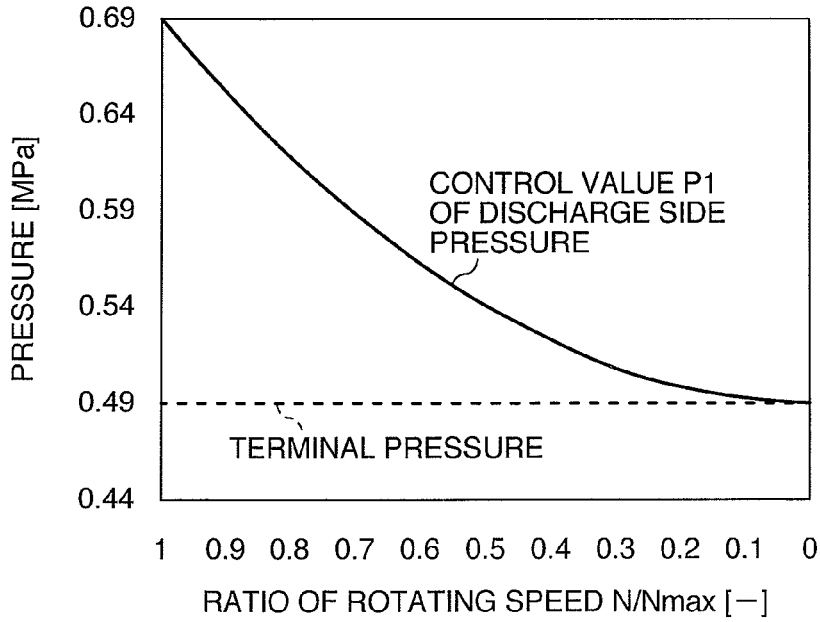
FIG. 2 is a characteristic view showing a relation between a rotating speed ratio of an electric motor and a control value of a discharge pressure of a compressor in the first embodiment of the compressed air manufacturing facility in accordance with the present invention.

FIG. 2 is a characteristic view showing a relation between a ratio of the rotating speed N/Nmax of the electric motor 2 and the control value P1 of the discharge pressure of the compressor 1 which are obtained on the basis of a result of computation of the expressions (1) and (2) mentioned above. In this case, a solid line indicates the control value P1 of the discharge pressure of the compressor 1, and a dotted line indicates a terminal pressure of the discharge air system 7.

In this FIG. 2, the predetermined control set value P1_0 of the discharge pressure of the compressor 1 is set to 0.69 MPa, and the maximum pressure loss ΔPmax of the discharge air system 7 is set to 0.2 MPa (that is, predetermined value of the terminal pressure P2=0.49 MPa). Further, the predetermined upper limit set value P1*u*_0 of the discharge pressure of the compressor 1 is set to 0.72 MPa, and the predetermined lower limit set value P1*d*_0 of the discharge pressure of the compressor 1 is set to 0.66 MPa.

Further, for example, in the case that the ratio of the rotating speed N/Nmax of the electric motor is equal to 0.5, the pressure loss ΔP of the discharge air system 7 is equal to 0.05 MPa, and the control value P1 of the discharge pressure of the compressor 1 is equal to 0.54. At this time, although an illustration is omitted, the upper limit value P1*u* of the discharge pressure of the compressor 1 is equal to 0.57 MPa in accordance with the computation of the expressions (3) and (4) mentioned above, and the lower limit value P1*d* is equal to 0.51 MPa. Further, for example, in the case that the ratio of the rotating speed N/Nmax of the electric motor 2 is equal to 0.2, the pressure loss ΔP of the discharge air system 7 is equal to 0.008 MPa, and the control value P1 of the discharge pressure of the compressor 1 is equal to 0.498. At this time, although an illustration is omitted, the upper limit value P1*u* of the discharge pressure of the compressor 1 is equal to 0.528 MPa and the lower limit value P1*d* is equal to 0.468 MPa in accordance with the computation of the expressions (3) and (4) mentioned above. Further, for example, in the case that the ratio of the rotating speed N/Nmax of the electric motor 2 is equal to 0, the pressure loss ΔP of the discharge air system 7 is equal to 0 MPa, and the control value P1 of the discharge pressure of the compressor 1 is equal to 0.49. At this time, although an illustration is omitted, the upper limit value P1*u* of the discharge pressure of the compressor 1 is equal to 0.52 MPa and the lower limit value P1*d* is equal to 0.46 MPa in accordance with the computation of the expressions (3) and (4) mentioned above.

Turning back to FIG. 1, the control apparatus 4 is structured such as to variably control the rotating speed N of the electric motor 2 via the inverter 3 in such a manner that the discharge pressure of the compressor 1 detected by the pressure sensor 9 comes to the computed control range mentioned above, as a second function (a rotating speed control means). In other words, the control apparatus 4 is structured, for example, such as to execute a PID computation on the basis of a deviation between the discharge pressure of the compressor 1 input from the pressure sensor 9 and the computed control value P1 mentioned above, and output a computed value (a rotating speed command 0 to 1 to the electric motor 2) to the inverter 3, and the inverter 3 is structured such as to output a frequency corresponding to the computed value from the control apparatus 4 to the motor 2, and variably control the rotating speed of the motor 2.

A description will be given of a motion, and an operation and effect of the compressed air manufacturing facility in accordance with the present embodiment. In this case, the ratio of the used air amount of the supply end and the ratio of the discharge air amount of the compressor 1 are expressed on the basis of the maximum amount of the discharge air of the compressor 1 (100%).

For example, in the case that the ratio of the used air amount is 100%, the ratio of the rotating speed N/Nmax of the electric motor 2 comes to 100%, and the ratio of the discharge air amount of the compressor 1 comes to 100%. At this time, the pressure loss ΔP of the discharge air system 7 becomes equal to ΔPmax=0.2 MPa, and the discharge pressure of the compressor 1 is maintained to the predetermined control set value P1_0=0.69 MPa. As a result, the terminal pressure of the discharge air system 7 is maintained to 0.49 MPa.

Further, for example, the ratio of the used air amount is changed to 20% from 100%, the discharge pressure of the compressor 1 tries to ascend because the ratio of the discharge air amount of the compressor 1 is first 100%. The control apparatus 4 first executes the PID computation on the basis of the deviation between the discharge pressure of the compressor 1 detected by the pressure sensor 9 and the control set value P1_0, outputs the computed value to the inverter 3, and reduces the rotating speed N of the electric motor 2. Thereafter, the control apparatus 4 computes the pressure loss ΔP of the discharge air system 7 in correspondence to the reduced rotating speed N of the electric motor 2 in accordance with the expression (1) mentioned above, and computes the control range (the control value P1, the upper limit value P1*u* and the lower limit value P1*d*) of the discharge pressure of the compressor 1 in accordance with the expressions (2) to (4) mentioned above. Further, the control apparatus 4 executes the PID computation on the basis of the deviation between the discharge pressure of the compressor 1 detected by the pressure sensor 9 and the computed control value P1 mentioned above, outputs the computed value to the inverter 3, and further reduces, for example, the rotating speed of the electric motor 2. As mentioned above, the control apparatus 4 repeatedly executes the variable control of the rotating speed N of the electric motor 2, and the computation of the control range of the discharge pressure of the compressor 1. As a result, the ratio of the rotating speed N/Nmax of the electric motor 2 is reduced to 20%, and the discharge pressure of the compressor 1 comes to the control value P1=0.498 MPa. At this time, the pressure loss ΔP of the discharge air system 7 is equal to 0.008 MPa, and the terminal pressure of the discharge air system 7 is maintained to 0.49 MPa.

Thereafter, for example, if the ratio of the used air amount is changed in a range from 20% to 0%, the ratio of the rotating speed N/Nmax of the electric motor 2 reaches the lower limit value 20%, and the discharge pressure of the compressor 1 is increased up to 0.528 MPa because the ratio of the discharge air amount of the compressor 1 is 20%. At this time, the terminal pressure of the discharge air system 7 is increased up to 0.52 MPa. The control apparatus 4 determines that the discharge pressure of the compressor 1 detected by the pressure sensor 9 is equal to or more than an unload start pressure (the upper limit value P1*u*=0.528 MPa of the discharge pressure of the compressor 1 computed in correspondence to the ratio of the rotating speed N/Nmax=0.2 of the electric motor 2, in the present embodiment), controls the control valve 13 so as to drive the suction throttle valve 5, and switches to the unload operation of the compressor 1.

Further, if the unload operation of the compressor 1 is continued, the discharge pressure of the compressor 1 descends to the 0.498 MPa because the ratio of the discharge air amount of the compressor 1 is 0%. The control apparatus 4 determines that the discharge pressure of the compressor 1 detected by the pressure sensor 9 is equal to or less than a load return pressure (the control value P1=0.498 MPa of the discharge pressure of the compressor computed in correspondence to the ratio of the rotating speed N/Nmax=0.2 of the electric motor 2, in the present embodiment), controls the control valve 13 so as to disconnect the suction throttle valve 5, and switches to the load operation of the compressor 1.

Further, for example, in the case that the compressor 1 is stopped in spite that the ratio of the used air amount is not 0%, the discharge pressure of the compressor 1 descends to 0.46 MPa because the ratio of the discharge air amount of the compressor 1 is 0%. At this time, the terminal pressure of the discharge air system 7 descends to 0.46 MPa. The control apparatus 4 determines that the discharge pressure of the compressor 1 detected by the pressure sensor 9 is equal to or less than the operation return pressure (the lower limit value P1*d*=0.46 MPa of the discharge pressure of the compressor 1 computed in correspondence to the ratio of the rotating speed N/Nmax=0 of the electric motor 2, in the present embodiment), and restarts the operation of the compressor 1.

As mentioned above, in the present embodiment, the control apparatus 4 computes the pressure loss ΔP of the discharge air system 7 in correspondence to the rotating speed of the electric motor 2, and changes the control range of the discharge pressure of the compressor 1 on the basis of the computation in such a manner that the terminal pressure in a downstream side position 15*b* of the discharge air system 7 comes to a predetermined range (0.46 MPa to 0.52 MPa in the present embodiment). Further, the control apparatus 4 variably controls the rotating speed of the electric motor 2 via the inverter 3 in such a manner that the discharge pressure of the compressor 1 detected by the pressure sensor 9 comes to the changed control range. Accordingly, it is possible to hold the power of the compressor 1 to a minimum while keeping the terminal pressure of the discharge air system 7 in the predetermined range, and it is possible to obtain an energy saving effect. Further, in the present embodiment, since there are provided with the function of changing the control range of the discharge pressure of the compressor 1 in correspondence to the rotating speed of the electric motor 2, and the function of variably controlling the rotating speed of the electric motor 2 in correspondence to the discharge pressure of the compressor 1, and the these two functions operate as feedback control functions with each other, it is possible to increase a convergence characteristic of the discharge pressure of the compressor 1 and the rotating speed of the electric motor 2. As a result, it is possible to stabilize the terminal pressure of the discharge air system 7, that is, the supply pressure. Accordingly, in the present invention, it is possible to increase a stability of the supply pressure while obtaining the energy saving effect.

In this case, in the first embodiment mentioned above, the control apparatus 4 is explained by exemplifying the case that the pressure loss ΔP of the discharge air system 7 is computed by substituting the ratio of the rotating speed N/Nmax=0.2 of the electric motor 2 for the expression (1) mentioned above, at a time of the unload operation of the compressor 1, however, is not limited to this. In other words, for example, the control apparatus 4 may compute by replacing the ratio of the rotating speed N/Nmax=0.2 of the electric motor 2 substituted for the expression (1) mentioned above by zero. In the case mentioned above, it is possible to obtain the same effect as mentioned above.

A description will be given of a second embodiment in accordance with the present invention with reference to FIGS. 3 and 4. The present embodiment corresponds to an embodiment in which a plurality of compressor units are provided.

Figure 3:
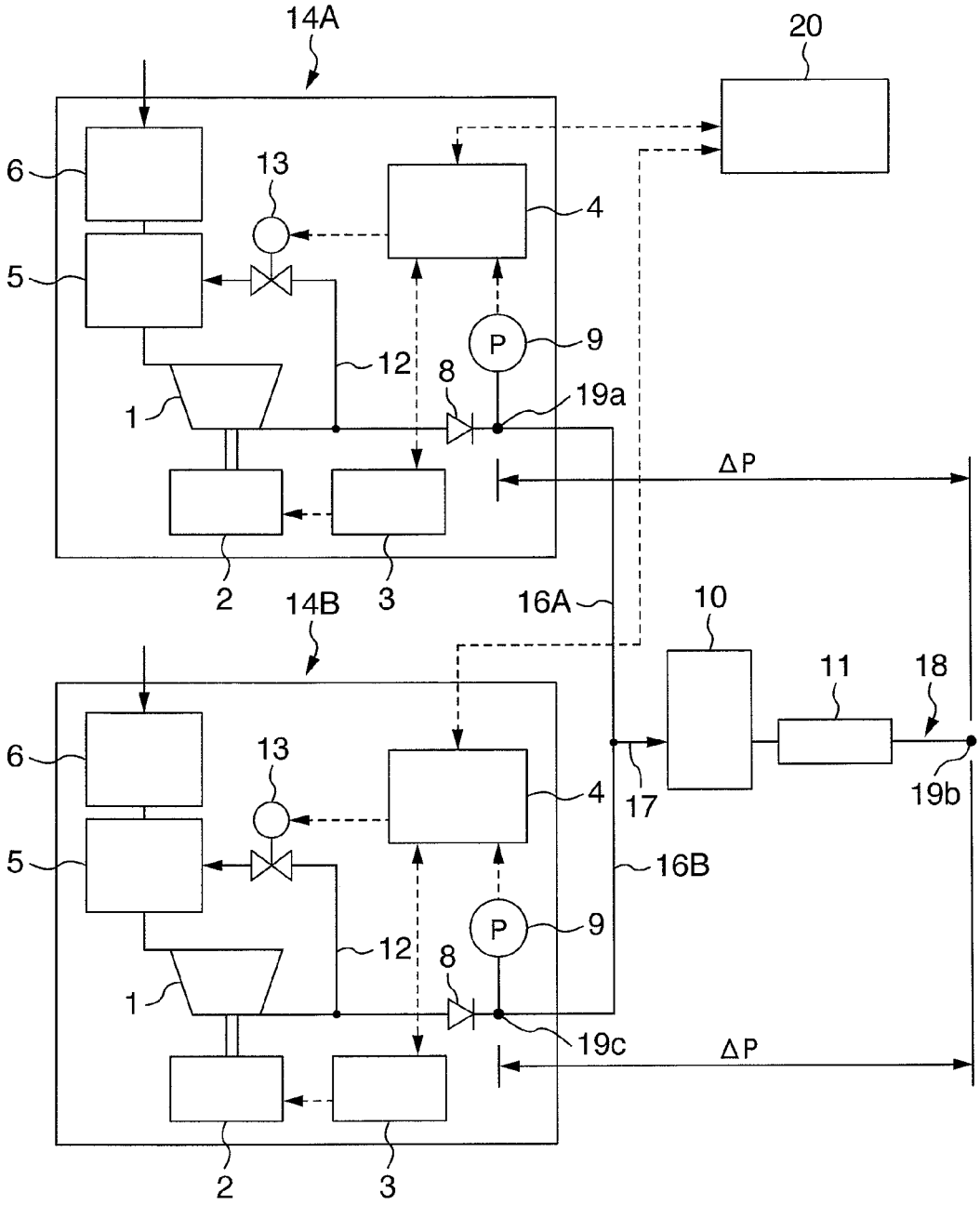
FIG. 3 is a schematic view showing an entire structure of a second embodiment of the compressed air manufacturing facility in accordance with the present invention.

FIG. 3 is a schematic view showing an entire structure of a compressed air manufacturing facility in accordance with the present embodiment. In this case, the same reference numerals are attached to the same parts as those of the first embodiment mentioned above, and a description thereof will be appropriately omitted.

In this FIG. 3, the compressed air manufacturing facility in accordance with the present embodiment is provided, for example, with two compressor units 14A and 14B, and each of the compressor units 14A and 14B is provided with a compressor 1 compressing the air, an electric motor 2 driving the compressor 1, an inverter 3 variably controlling a rotating speed of the electric motor 2, a control apparatus 4 controlling the inverter 3, a suction throttle valve 5 provided in a suction side of the compressor 1, and a suction filter 6 provided in an upstream side of the suction throttle valve 5, and removing a powder dust or the like in the atmospheric air, in the same manner as the compressor 14 mentioned above.

Discharge pipings 16A and 16B are respectively connected to a discharge side of the compressor 1 in the compressor units 14A and 14B, and each of the discharge pipings 16A and 16B is provided with a check valve 8, a pressure sensor 9 (a pressure detecting means) arranged in a downstream side of the check valve 8 and detecting a discharge pressure of the compressor 1. The discharge pipings 16A and 16B are connected in such a manner as to flow together with a supply piping 17, and the supply piping 17 is provided with an air tank 10 having a sufficient capacity, and an air filter 11 arranged in a downstream side of the air tank 10 and removing the powder dust or the like in the compressed air. Further, the discharge pipings 16A and 16B and the supply piping 17 construct a discharge air system 18. In this case, in the present embodiment, a pressure loss from a detection position 19*a* (an upstream side position) of the pressure sensor 9 of the compressor unit 14A in the discharge air system 18 to a downstream side position 19*b* is approximately equal to a pressure loss from a detection position 19*c* (an upstream side position) of the pressure sensor 9 of the compressor unit 14B to the downstream side position 19*b*, and these pressure losses are collectively called as a pressure loss ΔP of the discharge air system 18.

Further, there is provided an external control apparatus 20 concentrically controlling the control apparatus 4 of the compressor units 14A and 14B. The external control apparatus 20 is structured such as to operate any one compressor unit (hereinafter, refer to as a variable speed side compressor unit) of the compressor units 14A and 14B by variably controlling the rotating speed of the electric motor 2, and operate the other compressor unit (hereinafter, refer to a constant speed side compressor unit) by switching to a full-load operation state in which the rotating speed of the electric motor 2 is set to an upper limit value, in the case that it is impossible to compensate only by the discharge air amount of the variable speed side compressor unit, and switching to a stop state in the case that it is possible to compensate only by the discharge air amount of the variable speed side compressor unit. Further, the external control apparatus 20 controls the variable speed side compressor unit and the constant speed side compressor unit so as to alternate per a predetermined cycle. As a result, for example, even in the case that the variable speed side compressor unit is operated frequently, working times of the compressor units 14A and 14B are leveled. Further, for example, in the case that any one of the compressor units 14A and 14B get out of order for some reason, the external control apparatus 20 controls in such a manner as to switch the compressor unit which is not out of order to an individual operation.

Further, as a great feature of the present embodiment, the external control apparatus 20 is structured such as to compute the pressure loss ΔP of the discharge air system 18 in correspondence to a rotating speed Na of the electric motor 2 of the compressor unit 14A and a rotating speed Nb of the electric motor 2 of the compressor unit 14B, and change a control range of a discharge pressure of the compressor 1 in the variable speed side compressor unit on the basis of this computation in such a manner that a terminal pressure at the downstream side position 19*b* of the discharge air system 18 comes to a predetermined range. A description will be given below of details thereof.

The pressure loss ΔP of the discharge air system 18 is in proportion to a square of a total amount of the discharge air of the compressor units 14A and 14B. The external control apparatus 20 previously sets and stores a maximum pressure loss ΔPmax of the discharge air system 18, for example, at a time of a maximum total discharge air amount of the compressor units 14A and 14B (in other words, a maximum rotating speed Na_max of the electric motor 2 of the compressor unit 14A and a maximum rotating speed Nb_max of the electric motor 2 of the compressor unit 14B), and is structured such as to calculate the pressure loss ΔP of the discharge air system 18 by multiplying the maximum pressure loss ΔPmax of the discharge air system 18 by a square of an average value of ratios of the rotating speed Na/Na_max and Nb/Nb_max of the electric motor 2 respectively corresponding to the ratios of the discharge air amount of the compressor units 14A and 14B, as shown in Expression (5).

$$\Delta P=\Delta P\mathrm{max}\times\{(Na/Na_\mathrm{max}+Nb/Nb_\mathrm{max})/2\}2 \quad (5)$$

Further, for example, in the case of variably controlling the rotating speed Na of the electric motor 2 of the compressor unit 14A, the control value P1 of the discharge pressure of the compressor unit 14A is changed to a value obtained by adding the pressure loss ΔP mentioned above to a predetermined control value P2 of the terminal pressure (refer to Expression (2)). Further, an upper limit value P1*u* of the discharge pressure of the compressor unit 14A is changed to a value obtained by adding the pressure loss ΔP mentioned above to a predetermined upper limit value P2*u* of the terminal pressure (refer to Expression (3)). Further, a lower limit value P1*d* of the discharge pressure of the compressor unit 14A is changed to a value obtained by adding the pressure loss ΔP mentioned above to a predetermined lower limit value P2*d* of the terminal pressure (refer to Expression (4)).

In the same manner, for example, in the case of variably controlling the rotating speed of the electric motor 2 of the compressor unit 14B, the control value P1 of the discharge pressure of the compressor unit 14B is changed to the value obtained by adding the pressure loss ΔP to the predetermined control value P2 of the terminal pressure (refer to Expression (2)). Further, an upper limit value P1*u* of the discharge pressure of the compressor unit 14B is changed to the value obtained by adding the pressure loss ΔP to the predetermined upper limit value P2*u* of the terminal pressure (refer to Expression (3)). Further, a lower limit value P1*d* of the discharge pressure of the compressor unit 14B is changed to the value obtained by adding the pressure loss ΔP mentioned above to the predetermined lower limit value P2*d* of the terminal pressure (refer to Expression (4)).

Further, the control apparatus 4 of the variable speed side compressor is structured such as to unit variably control the rotating speed N of the electric motor 2 via the inverter 3 in such a manner that the discharge pressure of the compressor 1 detected by the pressure sensor 9 comes to the control range computed by the external control apparatus 20.

A description will be given of a motion, and an operation and effect of the compressed air manufacturing facility in accordance with the present embodiment. FIG. 4 is a time chart showing a variation with age of the ratio of the used air amount in the present embodiment, the discharge pressure of the compressor 1 in the compressor units 14A and 14B, the ratio of the rotating speed Na/Na_max of the electric motor 2 of the compressor unit 14A, and the ratio of the rotating speed Nb/Nb_max of the electric motor 2 of the compressor unit 14B. In this case, the discharge pressure of the compressor 1 in the compressor unit 14A is shown in blocks A to G, and the discharge pressure of the compressor 1 in the compressor unit 14B is shown in blocks H to M.

Figure 4:
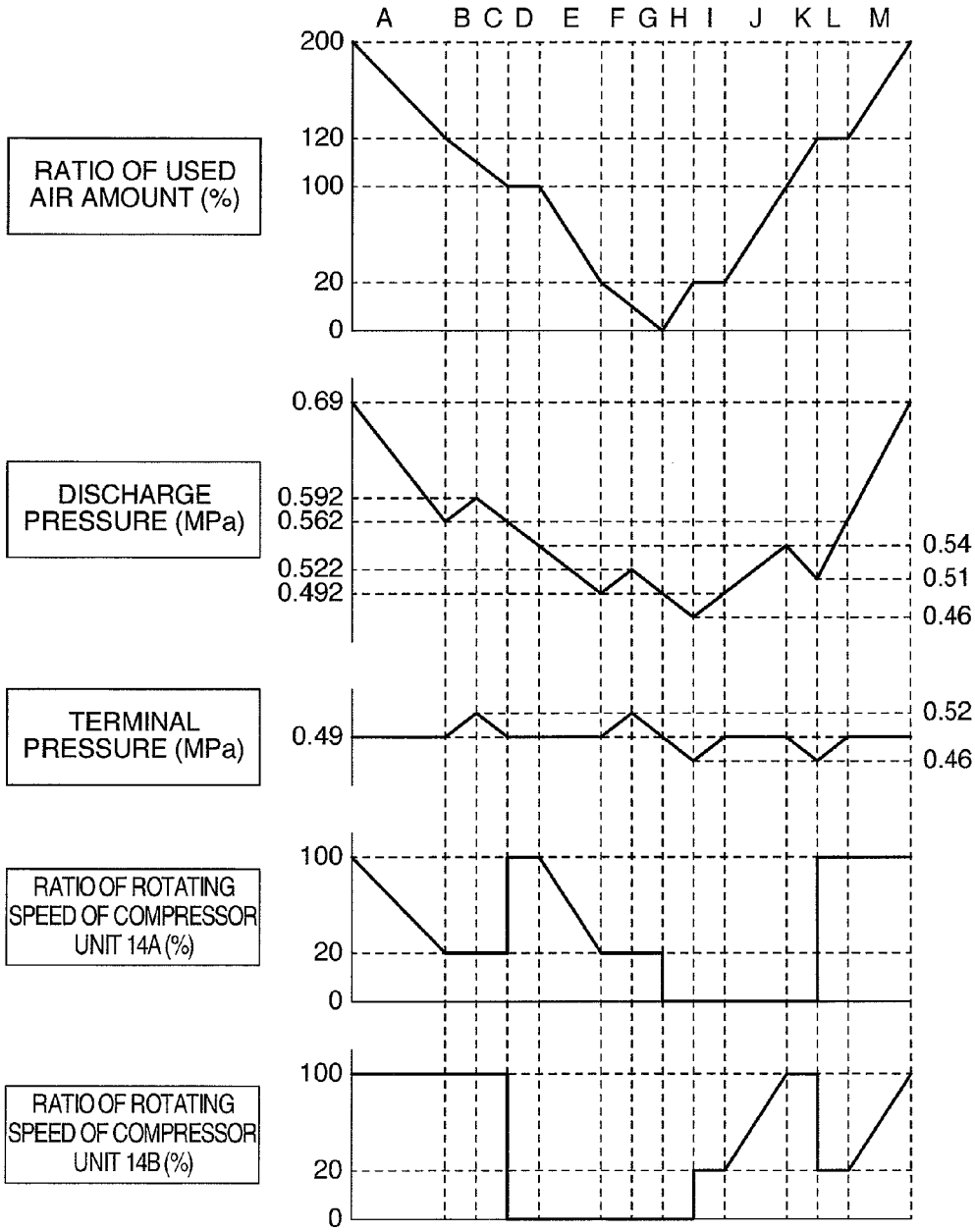
FIG. 4 is a time chart showing a variation with age of a ratio of an amount of a used air, a discharge pressure of a compressor and a ratio of a rotating speed of an electric motor in the second embodiment of the compressed air manufacturing facility in accordance with the present invention.

In this FIG. 4, the predetermined control set value P1 of the discharge pressure of the compressor 1 in the compressor units 14A and 14B is set to be equal to 0.69 MPa, the predetermined upper limit set value P1*u*_0 is set to be equal to 0.72 MPa, the predetermined lower limit set value P1*d*_0 is set to be equal to 0.66 MPa, and the maximum pressure loss ΔPmax of the discharge air system 18 is set to be equal to 0.2 MPa. Further, the ratio of the used air amount of the supply end and the ratio of the total discharge air amount of the compressor units 14A and 14B are expressed on the basis of the maximum amount of the discharge air of each of the compressor units (100%).

First, a description will be given of a case of variably changing the electric motor 2 of the compressor unit 14A at a time when the ratio of the used air amount is changed from 200% to 0%.

In the case that the ratio of the used air amount is 200%, each of the ratios of the rotating speed Na/Na_max and Nb/Nb_max of the electric motors 2 of the compressor units 14A and 14B comes to 100%, and each of the ratios of the discharge air amount of the compressor units 14A and 14B comes to 100%. At this time, the pressure loss ΔP of the discharge air system 18 is equal to ΔPmax=0.2 MPa. Further, in the compressor unit 14A, the discharge pressure of the compressor 1 is maintained to the predetermined control set value P1_0=0.69 MPa, and the terminal pressure of the discharge air system 18 is maintained to 0.49 MPa.

If the ratio of the used air amount is changed to 120% from 200% (a block A in FIG. 4), the discharge pressure of the compressor 1 in the compressor unit 14A tries to ascend because the ratio of the total discharge air amount of the compressor units 14A and 14B is first 200%. Accordingly, the control apparatus 4 of the compressor unit 14A first executes the PID computation on the basis of the deviation between the discharge pressure of the compressor 1 detected by the pressure sensor 9 and the control set value P1_0, outputs the computed value to the inverter 3, and reduces the rotating speed Na of the electric motor 2. Further, the external control apparatus 20 acquires the rotating speeds Na and Nb of the electric motor 2 from the control apparatuses 4 of the compressor units 14A and 14B, computes the pressure loss ΔP of the discharge air system 18 in correspondence to the rotating speeds Na and Nb of the electric motors 2 in accordance with the expression (5) mentioned above, and computes the control range (the control value P1, the upper limit value P1*u* and the lower limit value P1*d*) of the discharge pressure of the compressor 1 in the compressor unit 14A in accordance with the expressions (2) to (4) mentioned above. Thereafter, the control apparatus 4 of the compressor unit 14A executes the PID computation on the basis of the deviation between the discharge pressure of the compressor 1 detected by the pressure sensor 9 and the control value P1 computed by the external control apparatus 20, outputs the computed value to the inverter 3, and reduces, for example, the rotating speed Na of the electric motor 2. As mentioned above, there are repeatedly executed the variable control of the rotating speed Na of the electric motor 2 by the control apparatus 4 of the compressor unit 14A, and the computation of the control range of the discharge pressure of the compressor 1 by the external control apparatus 20. As a result, the ratio of the rotating speed Na/Na_max of the electric motor 2 of the compressor unit 14A is reduced to 20%, and the discharge pressure of the compressor 1 in the compressor unit 14A comes to the control value P1=0.562 MPa. At this time, the pressure loss ΔP of the discharge air system 18 is equal to 0.072 MPa, and the terminal pressure of the discharge air system 18 is maintained to 0.49 MPa.

If the ratio of the used air amount is changed in a range from 120% to 100% (a block B in FIG. 4), the ratio of the rotating speed Na/Na_max of the electric motor 2 of the compressor unit 14A reaches the lower limit value 20%, and the discharge pressure of the compressor 1 in the compressor unit 14A is increased up to 0.592 MPa because the ratio of the total discharge air amount of the compressor units 14A and 14B is 120%. At this time, the terminal pressure of the discharge air system 18 is increased up to 0.52 MPa. The external control apparatus 20 determines that the discharge pressure of the compressor 1 in the compressor unit 14A is equal to or more than an unload start pressure (the upper limit value P1*u*=0.592 MPa of the discharge pressure of the compressor 1 in the compressor unit 14A computed in correspondence to the ratio of the rotating speed Na/Na_max=0.2 of the electric motor 2 of the compressor unit 14A and the ratio of the rotating speed Nb/Nb_max=1 of the electric motor 2 of the compressor unit 14B, in the present embodiment), and switches the compressor unit 14A to the unload operation.

If the unload operation of the compressor unit 14A is continued (a block C in FIG. 4), the discharge pressure of the compressor 1 in the compressor unit 14A descends to the 0.562 MPa because the ratio of the total discharge air amount of the compressor units 14A and 14B is 100%. The external control apparatus 20 measures an unload operation time until the discharge pressure of the compressor 1 in the compressor unit 14A reaches a load return pressure (the control value P1=0.562 MPa of the discharge pressure of the compressor 1 in the compressor unit 14A computed in correspondence to the ratio of the rotating speed Na/Na_max=0.2 of the electric motor 2 of the compressor unit 14A and the ratio of the rotating speed Nb/Nb_max=1 of the electric motor 2 of the compressor unit 14B, in the present embodiment), and switches the ratio of the rotating speed Na/Na_max of the electric motor 2 of the compressor unit 14A to 100% as well as stopping the electric motor of the compressor unit 14B, in the case that the unload operation time gets over a predetermined time.

If the operation is continued at the ratio of the used air amount of 100% (a block D in FIG. 4), there are repeatedly executed the variable control of the rotating speed Na of the electric motor 2 by the control apparatus 4 of the compressor unit 14A and the computation of the control range of the discharge pressure of the compressor 1 by the external control apparatus 20, and the discharge pressure of the compressor 1 in the compressor unit 14A comes to the control value P1=0.54 MPa. At this time, the pressure loss ΔP of the discharge air system 18 is equal to 0.05 MPa, and the terminal pressure of the discharge air system 18 is maintained to 0.49 MPa.

If the ratio of the used air amount is changed to 20% from 100% (a block E in FIG. 4), there are repeatedly executed the variable control of the rotating speed Na of the electric motor 2 by the control apparatus 4 of the compressor unit 14A and the computation of the control range of the discharge pressure of the compressor 1 by the external control apparatus 20, the ratio of the rotating speed Na/Na_max of the electric motor 2 of the compressor unit 14A is reduced to 20%, and the discharge pressure of the compressor 1 in the compressor unit 14A comes to the control value P1=0.492 MPa. At this time, the pressure loss ΔP of the discharge air system 18 is equal to 0.002 MPa, and the terminal pressure of the discharge air system 18 is maintained to 0.49 MPa.

If the ratio of the used air amount is changed in a range from 20% to 0% (a block F in FIG. 4), the ratio of the rotating speed Na/Na_max of the electric motor 2 of the compressor unit 14A reaches the lower limit value 20%, and the discharge pressure of the compressor 1 in the compressor unit 14A is increased up to 0.522 MPa because the ratio of the total discharge air amount of the compressor units 14A and 14B is 20%. At this time, the terminal pressure of the discharge air system 18 is increased up to 0.52 MPa. The external control apparatus 20 determines that the discharge pressure of the compressor 1 detected by the pressure sensor of the compressor unit 14A is equal to or more than an unload start pressure (the upper limit value P1*u*=0.522 MPa of the discharge pressure of the compressor 1 in the compressor unit 14A computed in correspondence to the ratio of the rotating speed Na/Na_max=0.2 of the electric motor 2 of the compressor unit 14A and the ratio of the rotating speed Nb/Nb_max=0 of the electric motor 2 of the compressor unit 14B, in the present embodiment), and switches the compressor unit 14A to the unload operation.

If the unload operation of the compressor unit 14A is continued (a block G in FIG. 4), the discharge pressure of the compressor 1 in the compressor unit 14A is decreased to 0.492 MPa because the ratio of the total discharge air amount of the compressor units 14A and 14B is 0%. The external control apparatus 20 measures an unload operation time until the discharge pressure of the compressor 1 detected by the pressure sensor 9 of the compressor unit 14A reaches a load return pressure (the control value P1=0.492 MPa of the discharge pressure of the compressor 1 in the compressor unit 14A computed in correspondence to the ratio of the rotating speed Na/Na_max=0.2 of the electric motor 2 of the compressor unit 14A and the ratio of the rotating speed Nb/Nb_max=1 of the electric motor 2 of the compressor unit 14B, in the present embodiment), and stops the electric motor 2 of the compressor unit 14A, in the case that the unload operation time gets over a predetermined time.

Next, a description will be given of a case of variably changing the electric motor 2 of the compressor unit 14B at a time when the ratio of the used air amount is changed from 0% to 200%.

If the ratio of the used air amount is changed to 20% from 0% (a block H in FIG. 4), the discharge pressure of the compressor 1 in the compressor unit 14B descends to 0.46 MPa because the ratio of the total discharge air amount of the compressor units 14A and 14B is 0%. At this time, the terminal pressure of the discharge air system 18 is decreased to 0.46 MPa. The external control apparatus 20 determines that the discharge pressure of the compressor 1 in the compressor unit 14B is equal to or less than an operation return pressure (the lower limit value P1*d*=0.46 MPa of the discharge pressure of the compressor 1 in the compressor unit 14B computed in correspondence to the ratio of the rotating speed Na/Na_max=0 of the electric motor 2 of the compressor unit 14A and the ratio of the rotating speed Nb/Nb_max=0 of the electric motor 2 of the compressor unit 14B, in the present embodiment), and sets the ratio of the rotating speed Nb/Nb_max of the electric motor 2 of the compressor unit 14B to 20% so as to drive.

If the ratio of the used air amount is continued at 20% (a block I in FIG. 4), there are repeatedly executed the variable control of the rotating speed Nb of the electric motor 2 by the control apparatus 4 of the compressor unit 14B and the computation of the control range of the discharge pressure of the compressor 1 by the external control apparatus 20, and the discharge pressure of the compressor 1 in the compressor unit 14B comes to the control value P1=0.492 MPa. At this time, the pressure loss ΔP of the discharge air system 18 is equal to 0.002 MPa, and the terminal pressure of the discharge air system 18 is maintained to 0.49 MPa.

If the ratio of the used air amount is changed to 100% from 20% (a block J in FIG. 4), there are repeatedly executed the variable control of the rotating speed Nb of the electric motor 2 by the control apparatus 4 of the compressor unit 14B and the computation of the control range of the discharge pressure of the compressor 1 by the external control apparatus 20, the ratio of the rotating speed Nb/Nb_max of the electric motor 2 of the compressor unit 14B is increased up to 100%, and the discharge pressure of the compressor 1 in the compressor unit 14B comes to the control value P1=0.54 MPa. At this time, the pressure loss ΔP of the discharge air system 18 is equal to 0.05 MPa, and the terminal pressure of the discharge air system 18 is maintained to 0.49 MPa.

If the ratio of the used air amount is changed from 100% to 120% (a block K in FIG. 4), the ratio of the rotating speed Nb/Nb_max of the electric motor 2 of the compressor unit 14B reaches the upper limit value 100%, and the discharge pressure of the compressor 1 in the compressor unit 14B is decreased to 0.51 MPa because the ratio of the total discharge air amount of the compressor units 14A and 14B is 100%. At this time, the terminal pressure of the discharge air system 18 is decreased to 0.46 MPa. The external control apparatus 20 determines that the discharge pressure of the compressor 1 detected by the pressure sensor 9 of the compressor unit 14B is equal to or less than an operation return pressure (the lower limit value P1*d*=0.51 MPa of the discharge pressure of the compressor 1 in the compressor unit 14B computed in correspondence to the ratio of the rotating speed Na/Na_max=0 of the electric motor 2 of the compressor unit 14A and the ratio of the rotating speed Nb/Nb_max=1 of the electric motor 2 of the compressor unit 14B, in the present embodiment), sets the ratio of the rotating speed Na/Na_max of the electric motor 2 of the compressor unit 14A to 100% so as to drive, and switches the ratio of the rotating speed Nb/Nb_max of the electric motor 2 of the compressor unit 14B to 20%.

If the ratio of the used air amount is continued at 120% (a block L in FIG. 4), there are repeatedly executed the variable control of the rotating speed Nb of the electric motor 2 by the control apparatus 4 of the compressor unit 14B and the computation of the control range of the discharge pressure of the compressor 1 by the external control apparatus 20, and the discharge pressure of the compressor 1 in the compressor unit 14B comes to the control value P1=0.562 MPa. At this time, the pressure loss ΔP of the discharge air system 18 is equal to 0.072 MPa, and the terminal pressure of the discharge air system 18 is maintained to 0.49 MPa.

If the ratio of the used air amount is changed to 200% from 120% (a block M in FIG. 4), there are repeatedly executed the variable control of the rotating speed Nb of the electric motor 2 by the control apparatus 4 of the compressor unit 14B and the computation of the control range of the discharge pressure of the compressor 1 by the external control apparatus 20, the ratio of the rotating speed Nb/Nb_max of the electric motor 2 of the compressor unit 14B is increased up to 100%, and the discharge pressure of the compressor 1 in the compressor unit 14B comes to the control value P1=0.69 MPa. At this time, the pressure loss ΔP of the discharge air system 18 is equal to 0.2 MPa, and the terminal pressure of the discharge air system 18 is maintained to 0.49 MPa.

As mentioned above, in the present embodiment, the external control apparatus 20 computes the pressure loss ΔP of the discharge air system 7 in correspondence to the rotating speed of the electric motors 2 of the compressor units 14A and 14B, and changes the control range of the discharge pressure of the compressor 1 in the variable speed side compressor unit on the basis of the computation in such a manner that the terminal pressure in the downstream side position 18*b* of the discharge air system 7 comes to a predetermined range (0.46 MPa to 0.52 MPa in the present embodiment). Further, the control apparatus 4 of the variable speed side compressor unit variably controls the rotating speed of the electric motor 2 via the inverter 3 in such a manner that the discharge pressure of the compressor 1 detected by the pressure sensor 9 comes to the control range changed by the external control apparatus 20. Accordingly, it is possible to hold the power of the compressor 1 to a minimum while keeping the terminal pressure of the discharge air system 7 in the predetermined range, and it is possible to obtain an energy saving effect. Further, in the present embodiment, since there are provided with the function of changing the control range of the discharge pressure of the compressor 1 in the variable speed side compressor unit in correspondence to the rotating speed of the electric motors 2 in the compressor units 14A and 14B, and the function of variably controlling the rotating speed of the electric motor 2 in correspondence to the discharge pressure of the compressor 1 in the variable speed side compressor unit, and the these two functions operate as feedback control functions with each other, it is possible to increase a convergence characteristic of the discharge pressure of the compressor 1 and the rotating speed of the electric motor 2 in the variable speed side compressor unit. As a result, it is possible to stabilize the terminal pressure of the discharge air system 7, that is, the supply pressure. Accordingly, even in the present invention, it is possible to increase a stability of the supply pressure while obtaining the energy saving effect, in the same manner as the first embodiment mentioned above.

In this case, in the second embodiment mentioned above, the description is given by exemplifying the case that two compressor units 14A and 14B are provided, and both of the compressor units 14A and 14B can variably control the rotating speed of the electric motor 2 via the inverter 3, however, the structure is not limited to this. In other words, the structure may be made, for example such that three of more compressor units are provided. Further, for example, at least one compressor unit of a plurality of compressor units may be structured such as to variably control the rotating speed of the electric motor 2 via the inverter 3 in the same manner as the compressor units 14A and 14B mentioned above, and the other compressor units may be structured such that the rotating speed of the electric motor 2 is fixed. Even in the case mentioned above, it is possible to obtain the same effect as the second embodiment mentioned above.

Further, although no particular description is given in the first and second embodiment mentioned above, the pressure loss characteristic varies with age due to the influence of the attachment of the powder dust or the like, in the air filter 11 provided in the discharge air systems 7 and 18. Accordingly, in order to correspond to this, the pressure loss ΔP of the discharge air systems 7 and 18 may be corrected in correspondence to the variation with age of the pressure loss characteristic of the air filter 11. Describing in detail, for example, in the case that the pressure loss of the air filter 11 at a time of the maximum amount of the discharge air is increased, for example, in increments of 0.01 MPa per 30 days, the correction is executed by computing a pressure loss increment value ΔPf of the air filter 11 on the basis of a timer function, and adding the pressure loss increment value ΔPf to the maximum pressure loss ΔPmax in the expressions (1) to (5) mentioned above. Further, for example, in the case that the air filter 11 is replaced by a new one, the pressure loss increment value ΔPf of the air filter 11 is initialized to 0. In this case, as an auxiliary machinery of the discharge air system in which the pressure loss characteristic varies with age, for example, there is an oil filter or the like in the case of employing an oil lubricated type compressor, in addition to the air filter 11, and it is possible to apply to this case. In the modified example mentioned above, it is possible to obtain the same effect as the first and second embodiments mentioned above.

A description will be given of a third embodiment in accordance with the present invention with reference to FIG. 5. The present embodiment corresponds to an embodiment structured such that a discharge air system connected to a plurality of compressor units can be separated.

Figure 5:
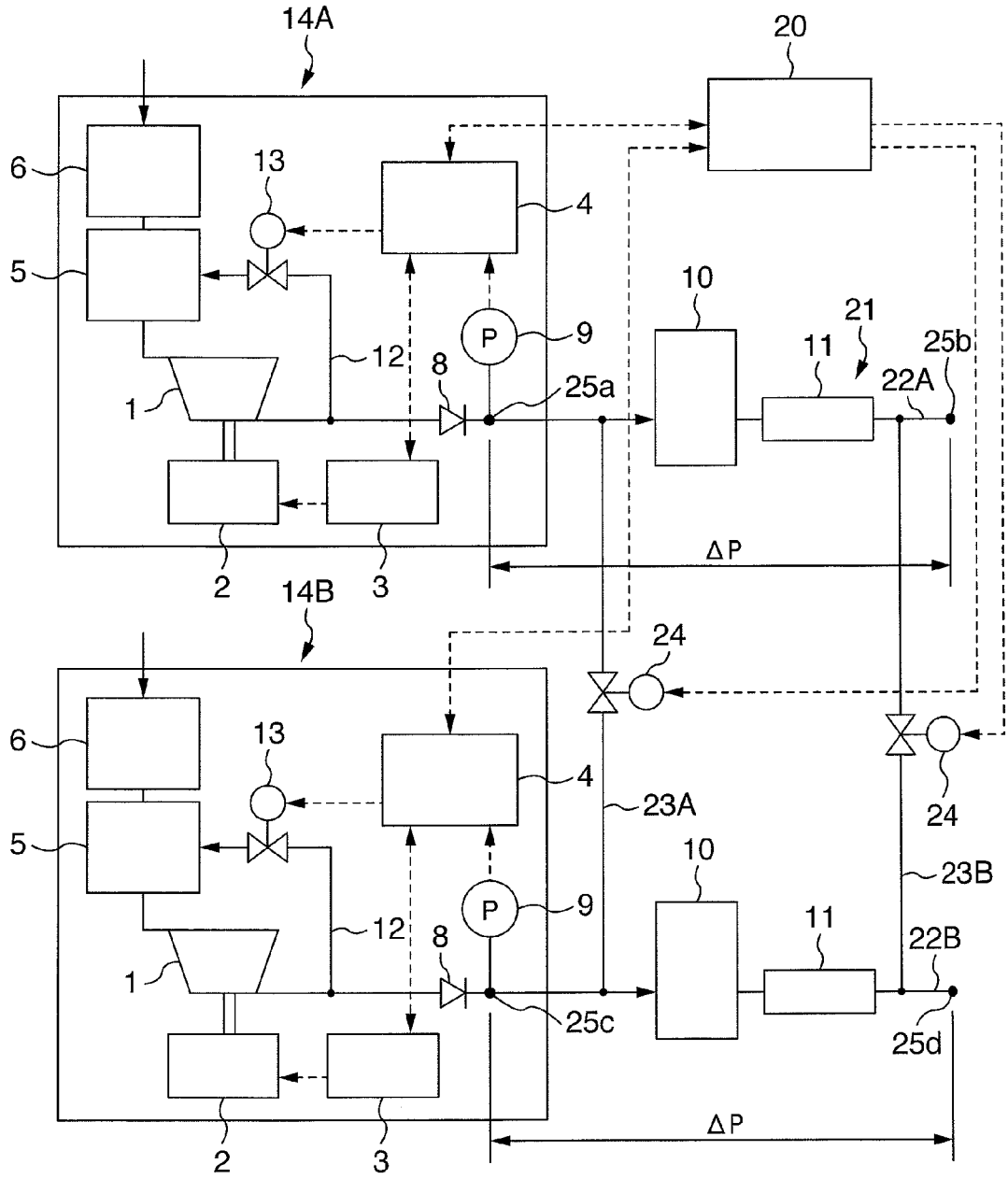
FIG. 5 is a schematic view showing an entire structure of a third embodiment of the compressed air manufacturing facility in accordance with the present invention.

FIG. 5 is a schematic view showing an entire structure of a compressed air manufacturing facility in accordance with the present embodiment. In this FIG. 5, the same reference numerals are attached to the same parts as those of the second embodiment mentioned above, and a description thereof will be appropriately omitted.

In the present embodiment, a discharge air system 21 has a supply system 22A which is connected to the discharge side of the compressor 1 of the compressor unit 14A and supplies the compressed air discharged from the compressor 1 to one supply end, and a supply system 22B which is connected to the discharge side of the compressor 1 of the compressor unit 14B and supplies the compressed air discharged from the compressor 1 to the other supply end, and each of these supply systems 22A and 22B is provided with the check valve 8, the pressure sensor 9, the air tank 10 and the air filter 11 in the order directed to a downward side. Further, a communication piping 23A is connected to a portion between an upstream side of the air tank 10 of the supply piping system 22A and an upstream side of the air tank 10 of the supply piping system 22B, a communication piping 23B is connected to a portion between a downstream side of the air filter 11 of the supply piping system 22A and a downstream side of the air filter 11 of the supply piping system 22B, and an opening and closing valve 24 is provided in each of the communication pipings 23A and 23B. In this case, in the present embodiment, a pressure loss from a detection position 25*a* (an upstream side position) of the pressure sensor 9 of the compressor unit 14A in the discharge air system 21 to a downstream side position 25*b* is approximately equal to a pressure loss from a detection position 25*c* (an upstream side position) of the pressure sensor 9 of the compressor unit 14B to a downstream side position 25*b*, and these pressure losses are collectively called as a pressure loss ΔP of the discharge air system 21.

The external control apparatus 20 is structured such as to output the control signal corresponding to a command signal from an input apparatus (not shown) to the opening and closing valve 23, and switch the opening and closing valve 23 to communication and shut-off states. Further, for example, in the case of switching the opening and closing valve 23 to the communication state, there is achieved a number control operation of combing the compressed airs from the compressor units 14A and 14B so as to supply to the supply end, whereby the same structure as the second embodiment mentioned above is achieved. In other words, the external control apparatus 20 changes the control range of the discharge pressure of the compressor 1 in the variable speed side compressor unit in correspondence to the rotating speeds Na and Nb of the electric motors 2 of the compressor units 14A and 14B. Further, the control apparatus 4 of the variable speed side compressor unit variably controls the rotating speed of the electric motor 2 via the inverter 3 in such a manner that the discharge pressure of the compressor 1 detected by the compressor sensor 9 comes to the control range changed by the external control apparatus 20.

On the other hand, for example, in the case of switching the opening and closing valve 23 to the shut-off state, there is achieved a parallel operation of respectively supplying the compressed airs from the compressor units to the supply ends, whereby each of the compressor units has the same structure as the first embodiment mentioned above. In other words, each of the compressor units 14A and 14B, the control apparatus 4 changes the control range of the discharge pressure of the compressor 1 in correspondence to the rotating speed of the electric motor 2, and variably controls the rotating speed of the electric motor 2 in such a manner that the discharge pressure of the compressor 1 detected by the pressure sensor 9 comes to the changed control range.

Even in the present embodiment structured as mentioned above, in the same manner as the first and second embodiments mentioned above, it is possible to increase a stability of the supply pressure while obtaining the energy saving effect. Further, in the present embodiment, since it is possible to divide the discharge air system 21 into the supply systems 22A and 22B, it is possible to easily correspond to the used condition of the compressed air.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A compressed air manufacturing facility, comprising:

a compressor configured to compress air;

a discharge air system connected to a discharge side of said compressor;

an electric motor configured to drive said compressor;

an inverter configured to variably control a rotating speed of said electric motor;

a pressure detecting means configured to detect the discharge pressure of said compressor at the upstream side position of said discharge air system;

a control apparatus configured to:

compute a pressure loss of said discharge air system, the pressure loss being a difference of the discharge pressure of said compressor at the upstream side position of said discharge air system as detected by said pressure detecting means, to a pressure at a downstream side position of said discharge air system, in correspondence to the rotating speed of said electric motor, change a control range of a discharge pressure of said compressor at an upstream side position of said discharge air system, on the basis of the pressure loss computation, in such a manner that a terminal pressure at a downstream side position of said discharge air system falls within a predetermined range, variably control the rotating speed of said electric motor via said inverter such that the discharge pressure of said compressor, as detected by said pressure detecting means, falls within the control range changed by said control apparatus, switch the compressor to an unload operation, when the discharge pressure of the compressor increases up to an unload start pressure, as detected by the pressure detecting means, during a load operation of the compressor, switch the compressor to a load operation, when the discharge pressure of the compressor decreases down to a load return pressure, as detected by the pressure detecting means, during an unload operation of the compressor, and change the unload start pressure and the load return pressure, such that a terminal pressure of an air discharge system falls within a predetermined range, on the basis of a pressure loss of the discharge air system as computed in correspondence to the rotating speed of said electric motor.

2. A compressed air manufacturing facility as claimed in claim 1, wherein said discharge air system has an auxiliary machinery configured to vary a pressure loss characteristic with age, and wherein said control apparatus is configured to correct the pressure loss of said discharge air system in correspondence to the variation with age of the pressure loss characteristic of said auxiliary machinery.

3. A compressed air manufacturing facility as claimed in claim 1, the control apparatus being further configured to:

switch the compressor from a stop state to an operational state, when the discharge pressure of the compressor decreases down to an operation return pressure, as detected by the pressure detecting means, during a time when the compressor is in a stop state; and change the operation return pressure, such that the terminal pressure of the air discharge system falls within a predetermined range, on the basis of a pressure loss of the discharge air system as computed in correspondence to the rotating speed of said electric motor.

4. A compressed air manufacturing facility, comprising:

a compressing means for compressing air;

a air discharge means connected to a discharge side of said compressing means;

an electric motoring means for driving said compressing means;

an inverting means for variably controlling a rotating speed of said electric motoring means;

a pressure detecting means for detecting the discharge pressure of said compressing means at the upstream side position of said air discharge means;

a control means for:

computing a pressure loss of said air discharge means, the pressure loss being a difference of the discharge pressure of said compressing means at the upstream side position of said air discharge means as detected by said pressure detecting means, to a pressure at a downstream side position of said air discharge means, in correspondence to the rotating speed of said electric motoring means, changing a control range of a discharge pressure of said compressing means at an upstream side position of said air discharge means, on the basis of the pressure loss computation, in such a manner that a terminal pressure at a downstream side position of said air discharge means falls within a predetermined range, variably controlling the rotating speed of said electric motoring means via said inverting means such that the discharge pressure of said compressing means, as detected by said pressure detecting means, falls within the control range changed by said control means, switching the compressing means to an unload operation, when the discharge pressure of the compressing means increases up to an unload start pressure, as detected by the pressure detecting means, during a load operation of the compressing means, switching the compressing means to a load operation, when the discharge pressure of the compressing means decreases down to a load return pressure, as detected by the pressure detecting means, during an unload operation of the compressing means, and changing the unload start pressure and the load return pressure, such that a terminal pressure of an air discharge system falls within a predetermined range, on the basis of a pressure loss of the air discharge means as computed in correspondence to the rotating speed of said electric motoring means.

5. A compressed air manufacturing facility as claimed in claim 4, wherein said air discharge means has an auxiliary machinery for varying, based on age, a pressure loss characteristic, and wherein said control apparatus for correcting the pressure loss of said air discharge means does so in correspondence to the variation with age of the pressure loss characteristic of said auxiliary machinery.

6. A compressed air manufacturing facility as claimed in claim 4, the control means being further for:

switching the compressing means from a stop state to an operational state, when the discharge pressure of the compressing means decreases down to an operation return pressure, as detected by the pressure detecting means, during a time when the compressing means is in a stop state; and changing the operation return pressure, such that the terminal pressure of the air discharge system falls within a predetermined range, on the basis of a pressure loss of the air discharge means as computed in correspondence to the rotating speed of said electric motoring means.

7. A compressed air manufacturing method, comprising:

compressing air, using a compressor with a air discharge system connected to a discharge side thereof;

driving said compressor, using an electric motor configured;

variably controlling a rotating speed of said electric motor, using an inverter;

detecting the discharge pressure of said compressor at the upstream side position of said air discharge system, by using a pressure detecting means;

computing, using a control apparatus, a pressure loss of said air discharge system, the pressure loss being a difference of the discharge pressure of said compressor at the upstream side position of said air discharge system as detected by said pressure detecting means, to a pressure at a downstream side position of said air discharge system, in correspondence to the rotating speed of said electric motor;

changing, using said control apparatus, a control range of a discharge pressure of said compressor at an upstream side position of said air discharge system, on the basis of the pressure loss computation, in such a manner that a terminal pressure at a downstream side position of said air discharge system falls within a predetermined range;

variably controlling, using said control apparatus, the rotating speed of said electric motor via said inverter such that the discharge pressure of said compressor, as detected by said pressure detecting means, falls within the control range changed by said control apparatus;

switching, using said control apparatus, the compressor to an unload operation, when the discharge pressure of the compressor increases up to an unload start pressure, as detected by the pressure detecting means, during a load operation of the compressor;

switching, using said control apparatus, the compressor to a load operation, when the discharge pressure of the compressor decreases down to a load return pressure, as detected by the pressure detecting means, during an unload operation of the compressor; and changing, using said control apparatus, the unload start pressure and the load return pressure, such that a terminal pressure of an air discharge system falls within a predetermined range, on the basis of a pressure loss of the air discharge system as computed in correspondence to the rotating speed of said electric motor.

8. A compressed air manufacturing method as claimed in claim 7, further comprising:

varying a pressure loss characteristic with age, by using said air discharge system which has an auxiliary machinery, and correcting the pressure loss of said air discharge system in correspondence to the variation with age of the pressure loss characteristic of said auxiliary machinery, by using said control apparatus.

9. A compressed air manufacturing method as claimed in claim 7, the method further comprising:

switching, using said control apparatus, the compressor from a stop state to an operational state, when the discharge pressure of the compressor decreases down to an operation return pressure, as detected by the pressure detecting means, during a time when the compressor is in a stop state; and changing, using said control apparatus, the operation return pressure, such that the terminal pressure of the air discharge system falls within a predetermined range, on the basis of a pressure loss of the air discharge system as computed in correspondence to the rotating speed of said electric motor.

* * * * *